US005929734A

United States Patent [19]

Weiner

[11] Patent Number: 5,929,734

[45] **Date of Patent: *Jul. 27, 1999**

[54] COIL FORMER FOR A FLAT COIL

[76] Inventor: René Weiner, Paulstrasse 7, 51702 Bergneustadt, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/895,394

[22] Filed: Jul. 16, 1997

[30] Foreign Application Priority Data

Jul. 18, 1996 [DE] Germany ..... 196 29 067

[51] Int. Cl.[6] ..... H01F 27/02; H01F 27/28

[52] U.S. Cl. ..... 336/61; 336/90; 336/192; 336/200; 336/232

[58] Field of Search ..... 336/61, 198, 208, 336/200, 232, 192, 98, 90

[56] References Cited

U.S. PATENT DOCUMENTS

| | | | |
|---|---|---|---|
| 5,010,314 | 4/1991 | Estrov | 336/198 |
| 5,179,365 | 1/1993 | Raggi | 336/192 |

FOREIGN PATENT DOCUMENTS

| | | | |
|---|---|---|---|
| 61-168617 | 10/1986 | Japan | 336/198 |
| 3-283404 | 12/1991 | Japan | 336/200 |
| 5-135968 | 6/1993 | Japan | 336/200 |
| 5-59818 | 8/1993 | Japan | 336/200 |
| 5-291062 | 11/1993 | Japan | 336/200 |
| 6-163266 | 6/1994 | Japan | 336/200 |
| 426249 | 10/1974 | U.S.S.R. | 336/61 |
| 2163603 | 2/1986 | United Kingdom | 336/200 |

*Primary Examiner*—Thomas J. Kozma
*Attorney, Agent, or Firm*—Howard & Howard

[57] ABSTRACT

A coil former for a flat coil comprises a plurality of printed circuit boards that are stacked on top of each other and carry one or several turns. At least one straight row of electrically conductive pins is arranged along the edge of a supporting plate which is made of insulating material. The pins are adapted to interconnect the strip conductors on the printed circuit boards and/or to connect the strip conductors with other components. The pins project in the direction towards the printed circuit boards. The pins are spaced apart according to a predetermined grid pitch. The supporting plate has a first recess for receiving a leg of a magnet. Further, the supporting plate is connectable with a cover having a second recess aligned with the first recess on the supporting plate.

16 Claims, 3 Drawing Sheets

COIL FORMER FOR A FLAT COIL

BACKGROUND OF THE INVENTION

The invention relates to a coil former for a flat coil comprising a plurality of printed circuit boards which are stacked on top of each other and carry one or several turns.

Flat coils are used as inductive components in the form of chokes, transformers, etc. in electronic circuit arrangements. The overall height of such components usually defines the total height of a printed circuit board equipped with various different components and therefore also the spacing between two printed circuit boards in a sub-assembly. Conventional coils have a relatively large overall height so that the number of printed circuit boards per sub-assembly is limited.

It is possible to stack a plurality of coil circuit boards on top of each other, wherein each of these printed circuit boards carries one or several turns. The strip conductors defining these turns may have a large surface, which reduces the influence of the skin effect and makes it possible to obtain high-strength currents at high frequencies. Further, in such an arrangement, the overall height for the coil is small and the inductive coupling between the turns on the printed circuit boards is large. There is the previously unsolved problem, however, of creating a coil former which receives the various turns and provides connecting members for connecting the ends of the turns with each other and with other components. This invention addresses that need.

SUMMARY OF THE INVENTION

It is the object of this invention to provide a coil former that has a simple structure and that is flexible in its use.

In general terms this invention provides a coil former for a flat coil comprising a plurality of printed circuit boards that are stacked on top of each other and carry one or several turns. The new coil former is characterized in that electrically conductive pins are arranged in a straight row along the edge of a supporting plate made of insulating material. The pins are adapted to connect the strip conductors on the boards and project in the direction towards the boards. The pins are spaced apart according to a predetermined grid pitch.

The supporting plate has a first recess for receiving the leg of a magnet, the supporting plate is connectable to a cover having a second recess aligned with the first recess, and the pins protrude through at least one side of the coil former when the cover is closed.

According to this invention, electrically conductive pins are embedded in the supporting plate. These pins serve two functions. One function is to electrically interconnect the turns of different printed circuit boards, thus creating windings having a predetermined number of turns. It is possible to create a plurality of windings within a single flat coil, e.g. for creating a transformer. The second function of the pins is to serve as terminal members for connecting the ends of the windings with other components.

In the invention, the pins are spaced apart according to a predetermined grid pitch. Preferably, a standard grid of the type commonly used in printed circuit boards and other connecting members is used as the grid pitch. In this manner, the ends of the pins can be inserted into contact holes on a printed circuit board and additional possibilities for connections can be provided by forming a given strip conductor structure on the printed circuit board. Using such a grid pitch in the coil former of this invention renders the flat coil more versatile in application. It should be noted that a pin is not necessarily provided for each grid point in the grid pitch. It is essential, however, that adjacent pins be spaced apart by a distance which is an integral or whole number multiple of the predetermined grid pitch.

Further, the supporting plate preferably is connectable with a cover, wherein both elements have recesses that are aligned with each other. This means that in the coil former of the invention, the supporting plate and the cover fulfil the function of a flange limiting the windings. The leg of a magnet core can be inserted through the recess for bundling the magnetic field lines generated by the current flowing through the windings.

The overall height of the flat coil formed with the help of the coil former is essentially defined by the number of printed circuit boards inserted. Due to the relatively large surface of the printed circuit boards (compared to thickness), it is possible to create a flat coil having a high merit and a small overall height.

Embodiments of the invention will be explained in the following detailed description in connection with the accompanying drawings.

DETAILED DESCRIPTION OF THE PREFERRED EMBODIMENT

Figure 1:
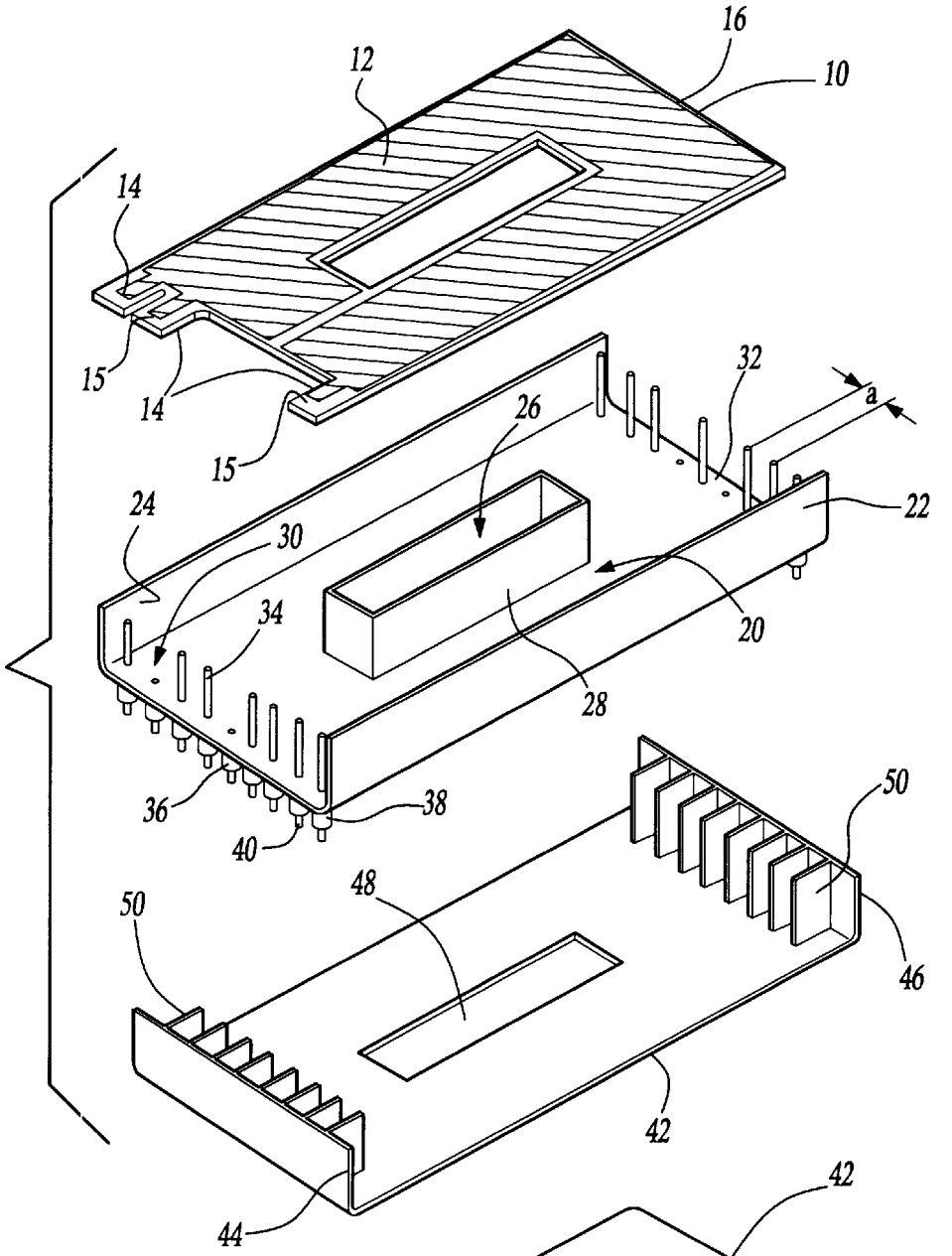
FIG. 1 is an exploded schematic view showing the structure of a flat coil designed according to this invention.

FIG. 1 is an exploded view showing components of a flat coil. A strip conductor 12 having a relatively large surface is arranged on a printed circuit board 10. The strip conductor 12 has three terminals 14. As usual in circuit board technology, each terminal 14 has a through bore 15. The strip conductor 12 defines a turn about a central recess or opening 16. The printed circuit board 10 can be made of a conventional rigid material, such as FR4 material, or of flexible material. The printed circuit board 10 may be coated on one or both sides or may be a multilayer board. FIG. 1 shows a single printed circuit board 10. It is to be understood that the complete flat coil comprises several printed circuit boards 10 stacked on top of each other and having aligned recesses 16.

The coil former of this invention has a supporting plate 20 and side walls 22, 24 that combine to form a generally U-shaped support. The supporting plate 20 includes an opening or recess 26 in its central portion. A rectangular insulating case 28 is arranged above the central recess 26. Printed circuit boards similar to printed circuit board 10 and having recesses 16 are arranged on the supporting plate 20 so that the case 28 is received in the recesses 16. The case 28 has the function of a winding body of a conventional coil former.

Two rows 30, 32 of pins 34 are arranged along the open ends of the support 20. The pins are fixed in holes 36 through the supporting plate 20. The pins 34 protrude in the direction towards the printed circuit board 10 for being guided through the through bores 15 of the terminals 14 and, if desired, for being connected with the strip conductor 12.

The pins 34 forming the rows 30, 32 are spaced apart according to a standard grid pitch indicated by the distance "a." This grid pitch preferably corresponds to the grid pitch usually used on conventional printed circuit boards. It is thus possible to connect the ends of the pins 34 with standard electrical components such as a printed circuit board, a terminal strip, etc. In the example shown in FIG. 1, the pins 34 protrude downwardly on the bottom side of the supporting plate 20. Spacer members 38 in the form of sleeves surrounding the pins 34 are provided on the bottom side of the supporting plate. The free end portion of each pin 34 protruding beyond the spacer members 38 serves as a terminal member 40, which can be inserted directly into a contact hole of a printed circuit board and soldered as appropriate. The spacer members 38 ensure that the bottom side of the supporting plate 20 has sufficient distance from an adjacent printed circuit board so that heat created on the bottom side of the supporting plate 20 can be dissipated by circulating air. As shown in FIG. 1, not every through hole 36 is occupied by a pin 34. The spacing between two adjacent pins 34 preferably always is an integral or whole number multiple of the grid pitch a.

The lower portion of FIG. 1 shows a cover 42 in the form of a U-shaped bracket. When the cover is closed, its side walls 44, 46 are slid onto the free ends of the supporting plate 20. The cover 42 also has a recess 48. When the cover is closed, the recess 48 is aligned with the recess 26 and the recess 16 of the printed circuit board 10. Insulating members 50 are arranged on the side walls 44, 46 and provide insulation between adjacent pins 34 when the cover 42 is closed. In this manner, the air gap and the leakage path between the pins 34 are increased and the electric strength of the entire flat coil is increased.

Figure 2A:
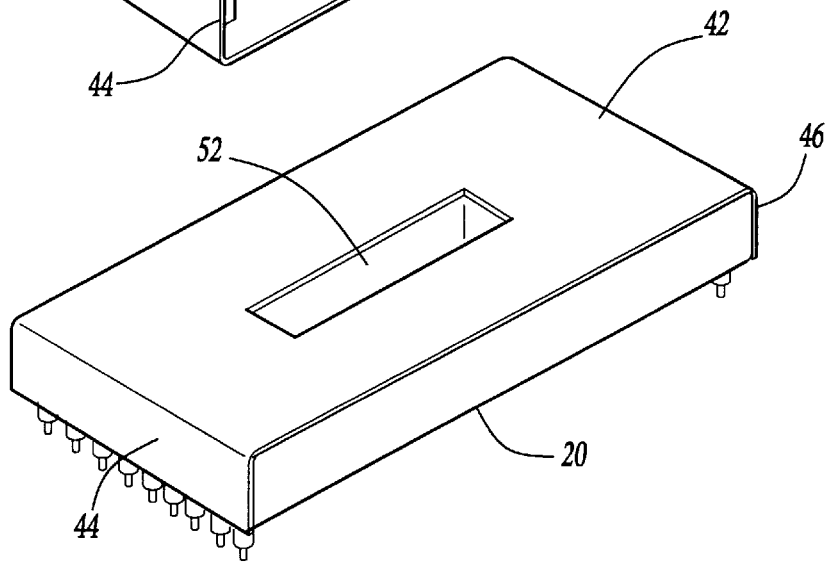
FIG. 2A is a view of a flat coil shown without a magnet core.

FIG. 2A shows the coil former with the closed cover 42 whose side walls 44, 46 close the open portions of the supporting plate 20 in a snug-fit manner. It should be noted that the open ends of the supporting plate 20 are useful (cf. FIG. 1) for permitting access to the pins 34 and the inserted printed circuit boards 10, e.g. for carrying out soldering or repair operations. The central leg of a magnet core can be introduced into the continuous opening 52 formed by the recesses 26, 16 and 48.

Figure 2B:
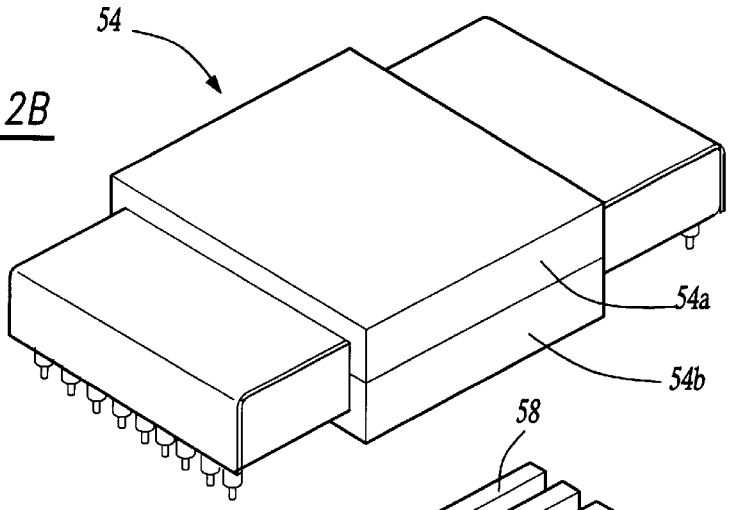
FIG. 2B is a view of a flat coil with a magnet core.

As shown in FIG. 2B, the magnet core 54 is composed of two halves 54*a*, 54*b*. Preferably, a magnet core having an E-shape is used. However, it is also conceivable to use other magnet shapes.

Figure 3:
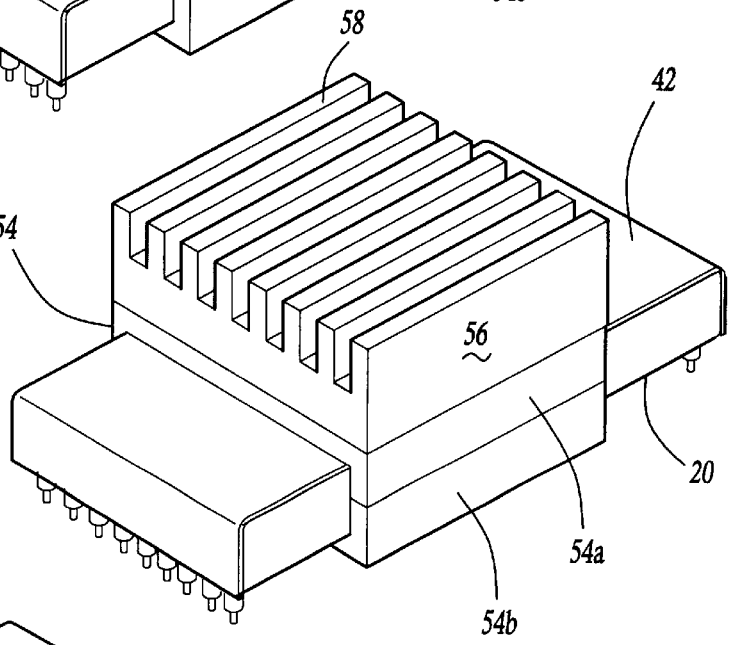
FIG. 3 is a view of a flat coil including the coil former of the invention and a heat sink.

FIG. 3 shows an embodiment of a flat coil in which a heat sink 56 having cooling ribs 58 is mounted on the top side of the upper half of the magnet core 54. Heat dissipation to the ambient air is increased by the heat sink 56. Due to the large surface area of the flat coil, the flat coil can operate with a larger dissipation of heat than a conventional coil.

Figure 4A:
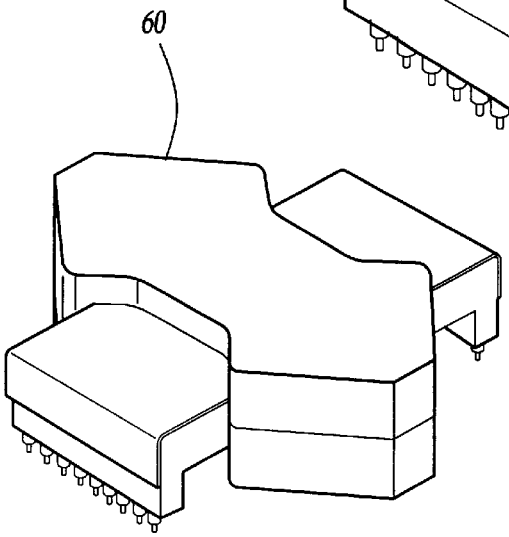
FIG. 4A shows an alternative embodiment of a flat coil.
Figure 4B:
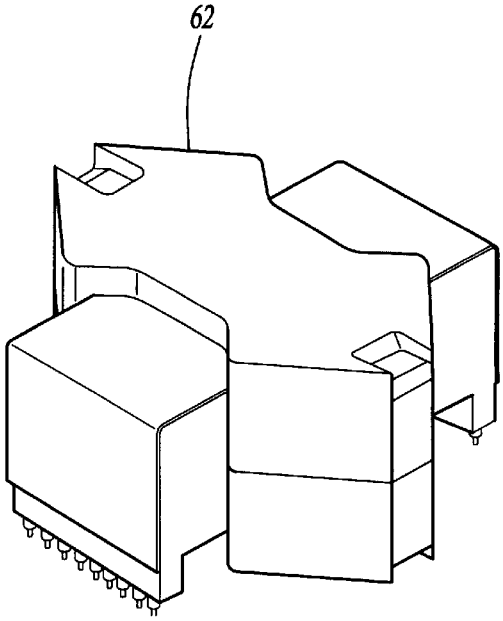
FIG. 4B shows another alternative embodiment of a flat coil.

FIGS. 4A and 4B show two embodiments of flat coils having magnet cores designed as shell-like cores 60 and 62 respectively. FIG. 4A shows a relatively flat coil. FIG. 4B shows a flat coil having a considerably larger overall height due to a larger number of printed circuit boards 10 received by the coil former.

Figure 5A:
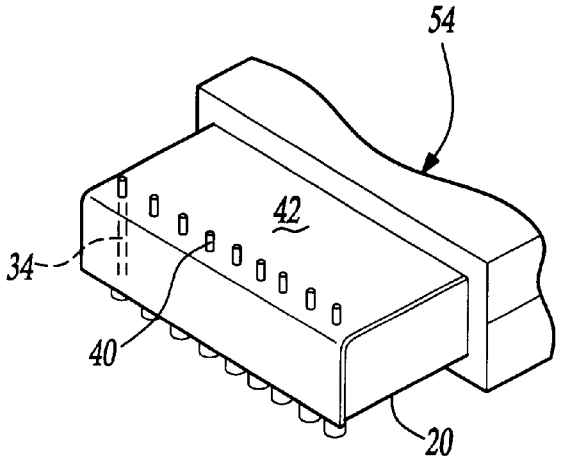
FIG. 5A shows a coil former having pins protruding on a top surface.
Figure 5B:
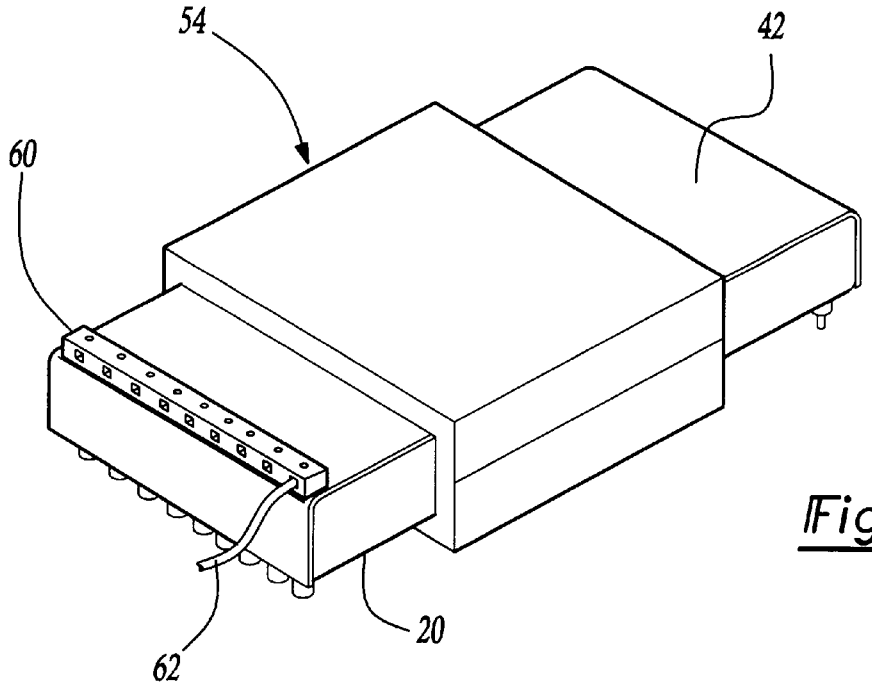
FIG. 5B shows the embodiment of Figure SA with a terminal strip placed on the protruding pins.

FIG. 5A shows another embodiment of the inventive coil former, wherein the pins 34 penetrate through holes in the cover 42 and protrude through the top. The end portions of the pins 34 form the outside terminal members 40. As shown in FIG. 5B, a terminal strip 60 with a standardized grid pitch is placed onto the terminal members 40.

Each pin 34 can be electrically connected with a connecting line 62 by means of the terminal strip 60. Of course, it is also possible to provide that, in addition, the pins 34 protrude downwardly on the bottom side of the supporting plate 20, whereby two terminal members are formed, namely one above the cover 42, and the other below the supporting plate 20. In this case, the pins 34 can be electrically connected with other components both on the bottom side of the supporting plate 20 and on the side of the cover 42.

The preceding description is intended to provide an example embodiment of this invention. The scope of legal protection for this invention can only be limited by the following claims.

What is claimed is:

1. A coil former and flat coil assembly comprising:

a plurality of printed circuit boards each having an outside dimension and which are stacked on top of each other and each having a strip conductor that includes at least one turn on one face of the board;

characterized in that at least one straight row of electrically conductive pins is arranged along the edge of a supporting plate made of insulating material, said pins projecting in a direction towards said printed circuit boards and being adapted to interconnect said strip conductors on said printed circuit boards;

wherein said pins are spaced apart according to a predetermined grid pitch, and the supporting plate has a first recess receiving a leg of a magnet and a case of insulating material which surrounds the first recess, the supporting plate also having side walls provided on two sides of the supporting plate that are opposite each other, the case and the side walls insulating the circuit boards from the magnet; and a cover having cover dimensions that are larger than outside dimensions of each of the printed circuit boards to completely cover the one face of the printed circuit boards and the strip conductors thereon and a second recess aligned with said first recess when said cover is connected with said supporting plate, and wherein end portions of said pins protrude through at least one side of said supporting plate for forming terminal members when said cover is connected with said supporting plate.

2. A coil former according to claim 1, characterized in that said supporting plate has spacer members on a bottom side facing away from said cover.

3. A coil former according to claim 1, characterized in that the end portions of the pins protrude through the bottom side of the supporting plate.

4. A coil former according to claim 3, characterized in that the spacer members are designed as sleeves for receiving the pins protruding on the bottom side.

5. A coil former according to claim 1, characterized in that the cover has through holes penetrated by the pins such that the pins protrude through the top of said cover.

6. A coil former according to claim 1, characterized in that a terminal strip having a connecting line and wherein each pin is connectable with the connecting line when said strip is arranged on the end portions of the pins.

7. A coil former according to claim 1, characterized in that the pins have a circular cross-section.

8. A coil former according to claim 1, characterized in that the supporting plate is rectangular, the side walls are on two sides of the supporting plate that do not have the rows of pins, and that the cover is designed as a generally U-shaped bracket having side walls in the region of the rows of pins.

9. A coil former according to claim 8, characterized in that the cover has insulating members for providing insulation between adjacent pins when the cover is connected with the supporting plate.

10. A coil former according to claim 1, further comprising a magnet core which is composed of two halves, wherein the central legs of said magnet core extend through the first and the second recesses.

11. A coil former according to claim 10, characterized in that the magnet core. is generally E-shaped.

12. A coil former according to claim 10, characterized in that a heat sink having cooling ribs is connected with the magnet core.

13. A coil former according to claim 1, characterized in that each printed circuit board has contact holes through which said pins extend for electrically connecting the ends of the strip conductors.

14. A coil former assembly according to claim 1, wherein said supporting plate is in a first plane and wherein said case extends away from said first plane.

15. A coil former assembly according to claim 1, wherein said magnet includes a body portion and said leg and wherein said body portion extends generally around an outer surface on said cover and an outer surface on said supporting plate.

16. A coil former assembly according to claim 1, wherein said leg of said magnet is received through said second recess.

* * * * *